United States Patent [19]

Gerwin

[11] 4,314,797

[45] Feb. 9, 1982

[54] METERING PISTON PUMP

[75] Inventor: Reinhard Gerwin, Stuttgart, Fed. Rep. of Germany

[73] Assignee: J. Eberspacher, Esslingen am Neckar, Fed. Rep. of Germany

[21] Appl. No.: 24,666

[22] Filed: Mar. 28, 1979

Related U.S. Application Data

[63] Continuation-in-part of Ser. No. 876,505, Feb. 9, 1978, abandoned, which is a continuation of Ser. No. 739,050, Nov. 5, 1976, abandoned, which is a continuation of Ser. No. 547,498, Feb. 6, 1975, abandoned.

[51] Int. Cl.[3] ..... F04B 7/04; F04B 17/04; F04B 21/02

[52] U.S. Cl. ..... 417/491; 417/496; 417/540; 417/555 R; 417/566; 417/567; 417/418

[58] Field of Search ..... 417/566, 567, 565, 540, 417/541, 555 R, 555 A, 491, 496, 417, 418

[56] References Cited

U.S. PATENT DOCUMENTS

| | | | |
|---|---|---|---|
| 110,177 | 12/1870 | Ward | 417/557 |
| 862,867 | 8/1907 | Eggleston | 417/390 |
| 2,819,678 | 1/1958 | Nordell | 417/570 |
| 3,058,140 | 10/1962 | Henss | 417/566 X |
| 3,941,516 | 3/1976 | Soberg | 417/259 |

FOREIGN PATENT DOCUMENTS

| | | | |
|---|---|---|---|
| 123282 | 9/1901 | Fed. Rep. of Germany | 417/240 |
| 2143230 | 3/1972 | Fed. Rep. of Germany | 417/505 |
| 2456843 | 6/1975 | Fed. Rep. of Germany | 417/540 |

*Primary Examiner*—Richard E. Gluck
*Attorney, Agent, or Firm*—Toren, McGeady & Stanger

[57] ABSTRACT

A metering fluid pump including a cylinder and a pumping piston movable therein, the cylinder being configured to define a liquid inlet chamber on one side of the piston and a liquid outlet chamber on the opposite side of the piston. A suction valve for the inlet chamber and a pressure valve for the outlet chamber open simultaneously when the piston is moving in a first direction to simultaneously pump liquid out of the outlet chamber and draw liquid into the inlet chamber. Both valves close when the piston is moved in a second reversed direction to transfer the liquid through a constricted conduit from the inlet chamber into the outlet chamber. In a second aspect of the invention an accumulator may be provided which receives liquid under pressure from the inlet chamber and which transfers the liquid into the outlet chamber when the piston is moved in the second direction and is at the end of its transfer stroke.

3 Claims, 5 Drawing Figures

METERING PISTON PUMP

This application is a Continuation-in-Part of application Ser. No. 876,505 filed Feb. 9, 1978, now abandoned, which is a Continuation of prior application Ser. No. 739,050 filed Nov. 5, 1976, now abandoned, which was in turn a Continuation of application Ser. No. 547,498 filed Feb. 6, 1975, now abandoned.

BACKGROUND OF THE INVENTION

The present invention relates generally to metering piston pumps and more particularly to piston-type fuel pumps for feeding a metered fuel supply to a combustion chamber.

In known metering pumps of the type to which the present invention relates for small amounts of liquids of the type contemplated herein, particularly where a delivery rate of two liters per hour or less is involved, complete filling of the outlet chamber of the pump is of significant importance if metering accuracy is to be maintained. Complete filling of the pump cylinder is achieved in known, single-action metering pumps utilized for pumping low-boiling point liquids, e.g. fuel injection pumps, by means of a second pump which feeds the flowing fluid under excess pressure to the inlet line of a metering stage of the device. These pumps, which are mostly provided with inlet control by the piston, feature relatively high metering accuracy. However, they tend to be generally quite complicated and to have a rather large overall volume. At least three flow-influenced valves are required, and these may include one suction valve and one pressure valve each on the feed pump and at least a pressure valve on the metering stage of the mechanism.

In order to reduce the production costs and the space requirements of such pumps, a preceding delivery or feeding stage may be eliminated with the metering stage performing the function of the suction phase of operation.

In such known proportioning pumps, the inlet of fluid is controlled by a flow-controlled suction valve. However, it has been found that a volume increase caused by the suction valve introduces disadvantageous operating conditions as does the resistance to flow of the suction valve.

In other known single-action metering piston pumps, particularly pumps for delivering fuel to a furnace, the fluid inlet is controlled by the piston. In such devices, undesired volume increases may be maintained relatively small but it is found that vacuum effects and cavitation appear in the pump cylinder. Particularly when the pump is operating to deliver low boiling point liquids, undesired steam bubbles are formed which prevent complete filling of the pump cylinder and thus detract from a high metering accuracy.

The present invention is aimed at providing a compact metering pump of the aforementioned type which features higher metering accuracy with lowered production costs and with lowered space requirements while at the same time permitting delivery of low boiling point liquids.

SUMMARY OF THE INVENTION

Briefly, the present invention may be described as a metering pump for liquids particularly suitable for feeding fuel to a furnace, comprising a cylinder and a pumping piston movable therein, said cylinder being configured to define a fluid inlet chamber including fluid inlet means on one side of said piston and a fluid outlet chamber including fluid outlet means on the opposite side of said piston. A suction valve is provided in the inlet means and a pressure valve is provided in the outlet means, with both valves being arranged to simultaneously open when said piston is moved in a first direction to draw fluid into the inlet chamber and to pump fluid out of the outlet chamber. When the direction of piston movement is reversed, the suction valve and the pressure valve both close and the piston moves through a part of its stroke in a second direction to effect transfer of the fluid contained in the inlet chamber into the outlet chamber. The outlet chamber is in flow communication with the inlet chamber through a throttled line formed by a constricted passage and as a result of the overall design and double-action of the pump of the present invention, complete filling of the pump cylinder is effected and thus a high metering accuracy results while at the same time construction costs and space requirements are considerably reduced. The formation of steam bubbles is prevented by the excess pressure expended by the feeding stage and an exact metering of low boiling liquids is made possible. The metering piston pump according to the invention also permits the pressure valve sealing the outlet chamber of the metering stage from the outlet line to be designed in such a way that disadvantageous volume effects are avoided. A flap member or tongue element may be utilized to operate as the suction valve with a low resistance with the suction valve being arranged between the suction or inlet chamber of the feeding stage and the inlet line. The design of the metering piston pump according to the invention also permits operation with only two valves.

According to a further feature of the invention, the double-acting piston operates in its rest position on the valve shutter of the suction valve and maintains it closed. This permits elimination of parts and a simpler design of the respective parts of the liquid pump while enabling maintenance of an effective seal.

In a further aspect of the invention the metering or proportioning pump is formed to comprise a cylinder and a piston, the cylinder being configured to define a fluid inlet chamber including fluid inlet means on one side of said piston and a fluid outlet chamber including fluid outlet means on the opposite side of said piston, with a suction valve being provided in the inlet means and a pressure valve being provided in the outlet means. Both valves are arranged to simultaneously open when the piston is moved in the first direction to draw fluid into the inlet chamber and to pump fluid out of the outlet chamber, and to close when the direction of piston movement is reversed. An hydraulic accumulator is arranged in flow communication with the inlet chamber, the pump functioning such that when the piston moves in the reversed direction, liquid present in the inlet chamber is forced under pressure into the hydraulic accumulator. At or near the end of the reversed piston stroke, flow communication is established between the hydraulic accumulator and the outlet chamber so that the pressurized liquid in the accumulator flows into and fills the outlet chamber. When the piston is then moved in the first or pumping direction, the valves open and fluid in the outlet chamber is pumped through the outlet means past the pressure valve with the inlet chamber being simultaneously filled with liquid through the inlet means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
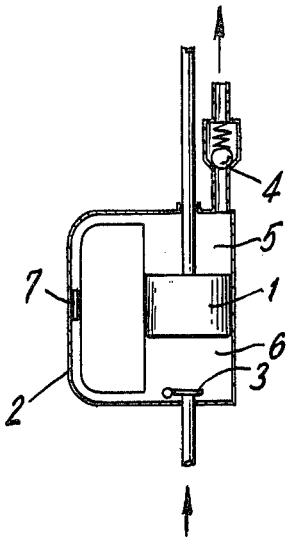
FIG. 1 is a schematic representation of a proportioning piston pump in accordance with the present invention.

In one embodiment of the invention depicted in FIG. 1, the metering pump is configured as including a double-acting piston 1 movable through its operating stroke within a cylinder 2. A displacement or outlet chamber 5, which forms the proportioning or metering stage of the device, is sealed off from the outlet line by a pressure valve 4. An inlet or suction chamber 6 forming the feeding stage of the device is sealed off from an inlet line by a suction valve 3 which comprises a flap valve. Means are provided for enabling transfer of fluid from the chamber 6 into the chamber 5, said means comprising a throttled or constricted line 7 connecting the chamber 5 with the chamber 6. In another embodiment of the invention (not shown) it is also possible to arrange the transfer conduit 7 to extend through the piston itself.

When the double-acting piston 1 moves in a reversed or downward direction, the fluid contained in the inlet chamber 6 is fed under excess pressure through the throttled line 7 into the displacement or outlet chamber 5, while the suction valve 3 and the pressure valve 4 remain closed. Displacement chamber 5 is filled automatically with the fluid medium, since the amount of fluid displaced in the suction chamber 6 has at least the same volume as the amount of liquid which is to be received in the displacement chamber 5. Furthermore, the outlet chamber 5 and the piston 1 should be structured and operated to cause the piston to move through substantially the entire volume defined by the chamber 5 during its working stroke so that substantially all the fuel contained within the chamber 5 will be expelled. Vacuum effects, cavitation and the formation of steam bubbles are thus prevented in the displacement chamber 5.

In the pump embodiment according to FIG. 1, the influence of the piston rod may be disregarded. It effects a metered partial discharge of the liquid over pressure valve 4 into the outlet line, while piston 1 moves downwardly. When piston 1 moves upwardly during the working stroke, the liquid enclosed in the displacement chamber 5 arrives in metered amounts in the outlet line, while additional liquid flows from the simultaneously opening suction valve 3 from the inlet line into suction chamber 6.

The portion of the fluid which might be returned during the working stroke of the piston from the displacement chamber 5 through the throttled line 7 into the suction chamber 6 is rather small and negligible, if the metering pump delivers against a low pressure head in the outlet line and if its piston speed or operating frequency is sufficiently high. Moreover, the portion of the fluid which is bypassed through the throttled line 7 during the working stroke will be of a constant amount and therefore does not reduce the metering accuracy of the device if the frequency and the path of motion of the piston 1, as well as the pressure head in the outlet line, are substantially constant. There are conditions which are mostly prevalent, particularly in the supply of fuel to a furnace.

Figure 2:
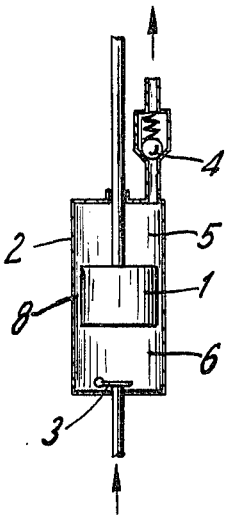
FIG. 2 is a schematic representation of another embodiment of the invention.

In FIG. 2, a second embodiment of the present invention is shown wherein the displacement chamber 5 of the piston pump is in communication with the suction chamber 6 through a gap of interval 8 which is formed between the piston 1 and the side wall of the cylinder 2. Inasmuch as the flow channel or gap 8 is formed merely by properly dimensioning the piston 1 and the cylinder wall 2, it may be provided in a device of the type described without any increased expenditure or difficulty. Additionally, the extent of the throttling effect which is produced by the gap 8 can be adapted in a simple manner to the respective use of the metering pump by exchanging piston 1.

Figure 3:
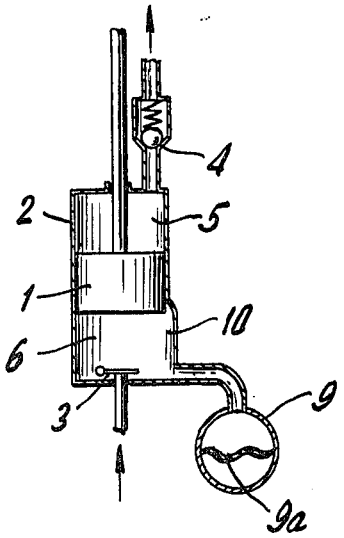
FIG. 3 is a schematic representation of still another embodiment of the invention.

In FIG. 3 there is shown a further embodiment of the invention wherein an hydraulic accumulator 9 is utilized. The accumulator 9 contains an adjustable diaphragm 9*a* and receives the liquid which is to be displaced in the suction chamber 6 wherein it is temporarily stored under excess pressure. The accumulator 9 is arranged in flow communication with the suction chamber 6 of the pump through a recess 10 which is formed in the cylinder wall 2. The recess 10 is configured with a somewhat greater axial length than the height of the piston 1 and thus, when the piston is at its lower dead center position, a connection between the accumulator 9 and the displacement chamber 5 will be effected through the recess 10 and about the piston 1. The liquid which is received by the accumulator 9 under excess pressure flows then into the displacement chamber 5 and fills the chamber 5 completely with existing steam bubbles being condensed by the excess pressure. The space 5 is completely filled since the parts of the pump are proportioned to ensure that the quantity of liquid which flows out of the accumulator is at least as great as the volume of the chamber 5.

Figure 4:
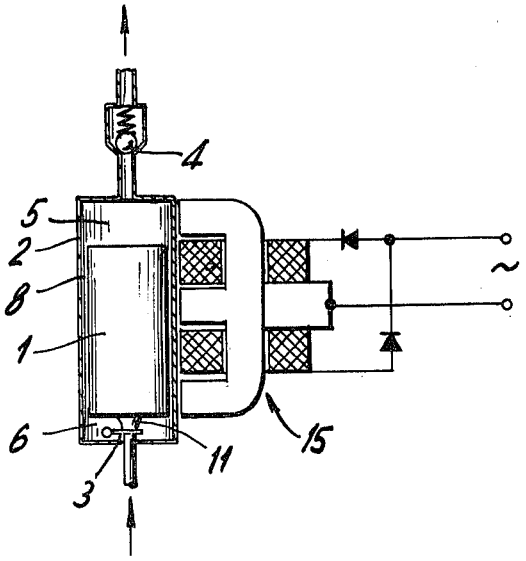
FIG. 4 is a schematic representation of a still further embodiment of the invention.

In FIG. 4, a further embodiment of the invention is disclosed wherein the double-acting piston 1 of the pump maintains the valve shutter of the suction valve 3 closed in its rest position by means of an extension 11 which engages the valve 3. This prevents liquid from flowing when the pump is not in operation. The provision of a special shutoff valve is therefore not necessary. The piston is driven by means of an electromagnetic drive means 15. The piston 1 is of ferromagnetic material and electro-magnet 15 suitable for a.c. operation serves to drive the piston; semi-conductor diodes ensure the correct polarity. The use of the electro-magnetic drive enables the pump to be hermetically sealed off from the outside air and, as there is no piston rod, the volumes swept by opposite ends of the piston are identical. In this embodiment, there is an intermediate passage 8, between the piston and the cylinder, forming a constriction as in the embodiment of FIG. 2.

In accordance with a preferred embodiment of the invention, the effect of the piston rod in the embodiment of FIG. 1 or FIG. 2 is made different by increasing the diameter of the piston rod. By suitably dimensioning the diameter of the piston rod relative to the cross-section of the piston 1 it is possible, for example, to arrange for the metering pump to deliver to the outlet duct (by way of the outlet valve 4) the same quantity of liquid during the forward movement of the piston as during the return movement thereof, i.e. the pump becomes double-acting. Thus, the known intermittent metering action of the metering pump becomes, in a large measure, a continuous metering action, while the above-described advantages remain.

It is thus possible, by a suitable choice of the above-mentioned ratio of cross-section, to alter, in practically any desired manner, the quantity of liquid delivered during the forward movement of the piston relative to the quantity of liquid delivered during the return (reverse) movement of the piston.

Figure 5:
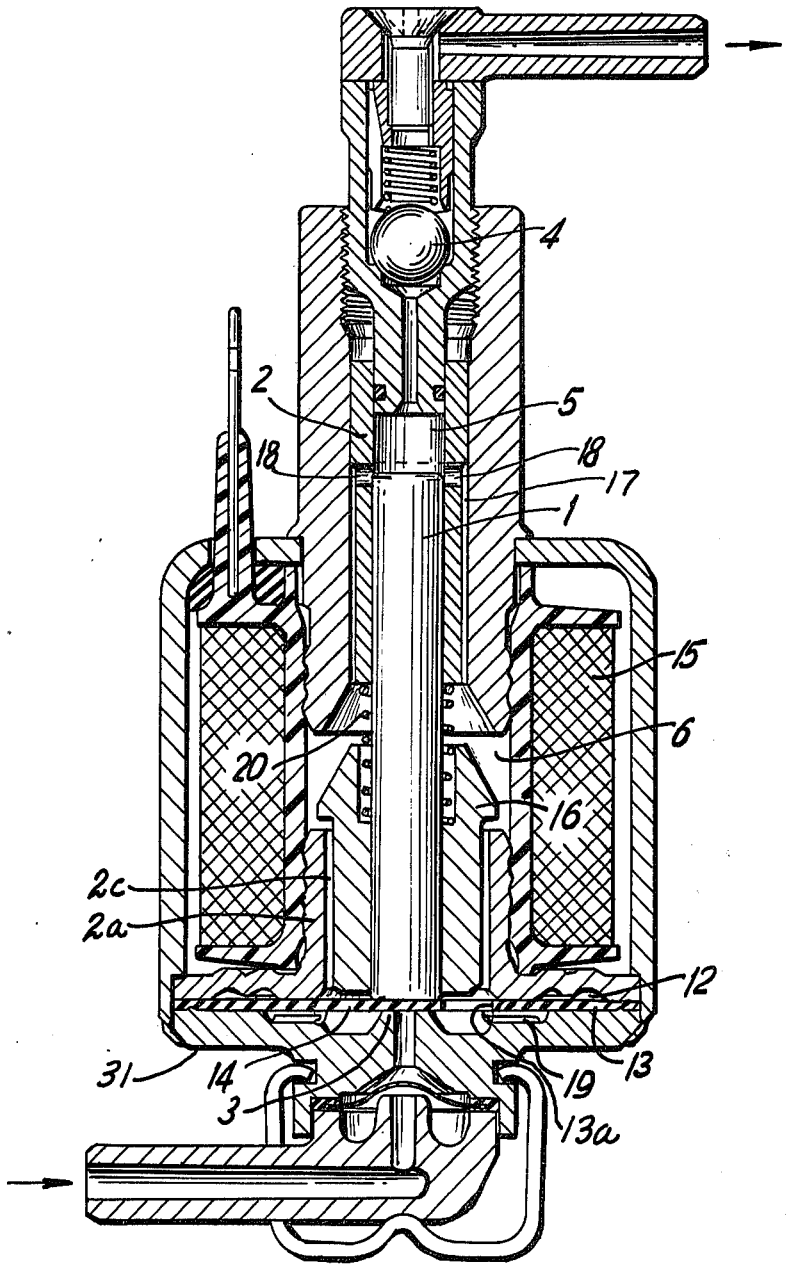
FIG. 5 is an axial sectional view of still another embodiment of the present invention.

A still further embodiment of a fuel piston pump for fuel furnaces according to the present invention is depicted in FIG. 5 wherein a suction chamber 6 contains an armature 16 fixed to a piston 1 reciprocable in a cylinder 2. The suction valve 3 comprises a movable tongue 14 forming part of a surrounding resilient annular disc 13 and when the piston is in the lowermost position, as shown, the piston engages the tongue so that the valve 3 is held closed. The disc 13 is clamped around its periphery between a sleeve 2*a* and a bottom part 31 of the pump housing and liquid communication is established between the lower end of the space 6 and the underside of the disc 13 by a wide gap 13*a* between the peripheral part of the disc and the tongue 14 and by radial ducts 19 formed in the part 31. An annular space or chamber 12 is defined between the upper surface of the disc 13 and the sleeve 2*a*. Energisation of a magnet coil 15 causes the piston 1 and armature 16 to move upwards against the bias of a return spring 20. As in FIG. 1, the spaces 5 and 6 constitute the pumping chamber.

In operation of the pump, when the coil 15 is de-energised the piston and armature move to the position shown by the action of the spring 20 and liquid displaced by the piston in the space 6 is pressurized and forced between the undersurface of the disc 13 and the housing part 31. The pressurised liquid forces the disc into the annular chamber 12, the disc thus constituting a hydraulic accumulator. At the bottom of the piston stroke ports 18 are uncovered as shown, so that pressurised liquid in the accumulator flows out of the accumulator and enters and fills the space 5 after passing along a path including ducts 19, gap 13*a*, annular space 2*c* and an annular space 17 surrounding the cylinder. The parts are so proportioned to ensure complete filling of the space 5 and any bubbles present are eliminated by pressurisation of the liquid.

When the magnet coil 15 is energised the armature 16 and piston 1 move upwardly against the action of the spring 20 and the ports 18 are closed, and a metered quantity of the liquid in the space 5 opens and passes through the delivery valve 4 to the outlet duct. Also, the tongue 14 lifts to open valve 3 and the suction space 6 refills with the liquid.

The elastic or resilient disc 13 may be supported in the vicinity of the accumulator cavity 12 by an annular leaf spring (not shown). However, a gas cushion may also be utilized as a support.

The drive means of the invention, such as the electromagnetic drive means 15 shown in FIG. 4, operate to reciprocally drive the piston through an operating stroke having a frequency of between 1 and 10 strokes per second. The drive means provided may be such as to impart to the piston a working stroke having a velocity which may be up to about one hundred times faster than the velocity of the return stroke of the piston occurring when the valves 3 and 4 are closed.

While specific embodiments of the invention have been shown and described in detail to illustrate the application of the inventive principles, it will be understood that the invention may be embodied otherwise without departing from such principles.

What is claimed is:

1. A metering pump particularly suitable for feeding fuel to a furnace comprising: means defining a pumping chamber; piston means movable through an operating stroke within said pumping chamber in a first direction and in a second direction opposite thereto; said pumping chamber being configured to define a fluid inlet chamber including fluid inlet means on one side of said piston means and a fluid outlet chamber including fluid outlet means on the opposite side of said piston means; first valve means in said fluid inlet means, said first valve means comprising a resilient flap member formed on a fixedly clamped disc of elastic material; second valve means in said fluid outlet means; said first valve means and said second valve means being arranged to simultaneously open when said piston means is moved in said first direction and to simultaneously close when said piston means is moved in said second direction; hydraulic accumulator means; and means establishing flow communication between said accumulator means and said pumping chamber; said pump being arranged such that when said piston means is moved in said first direction, fluid is drawn into said inlet chamber from a source thereof with fluid being simultaneously pumped from said outlet chamber, and such that when said piston means is moved in said second direction, fluid is pumped under pressure into said accumulator means from said inlet chamber during an initial portion of the movement of said piston means in said second direction; said communication means being arranged to establish flow communication with said outlet chamber during a latter portion of the movement of said piston means in said second direction to enable fluid in said accumulator means to flow into said outlet chamber; and a body portion comprising said means defining said pumping chamber with a cavity defined in said body portion adapted to constitute said hydraulic accumulator, said cavity being defined in part by said clamped disc such that when said piston means moves in said second direction, the clamped disc is deformed and fluid is forced into said cavity from said inlet chamber.

2. A metering pump according to claim 1 including means defining ports arranged in flow communication between said outlet chamber and said accumulator means, said ports being arranged to have flow therethrough blocked by said piston means except when said piston means is in said latter portion of its movement in said second direction whereupon said ports are opened to enable flow communication between said accumulator means and said outlet chamber.

3. A metering pump according to claim 1 wherein said piston means includes a part thereof arranged to engage said first valve means to hold said first valve means closed when said piston means is at the end of its movement in said second direction.

* * * * *